US008766860B2

(12) United States Patent
Li et al.

(10) Patent No.: US 8,766,860 B2
(45) Date of Patent: Jul. 1, 2014

(54) HOUSING COMBINATION OF ELECTRONIC DEVICE AND METHOD

(75) Inventors: Qi-Yuan Li, Shenzhen (CN); Yong Yan, Shenzhen (CN); Yong-Fa Fan, Shenzhen (CN); Xue-Li Zhang, Shenzhen (CN); Zhao-Yi Wu, Shenzhen (CN); Li Liu, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 307 days.

(21) Appl. No.: 13/220,873

(22) Filed: Aug. 30, 2011

(65) Prior Publication Data

US 2012/0249378 A1 Oct. 4, 2012

(30) Foreign Application Priority Data

Mar. 31, 2011 (CN) ..... 201110080079

(51) Int. Cl.
*H01Q 1/24* (2006.01)
*H01Q 1/40* (2006.01)

(52) U.S. Cl.
USPC ..... 343/702; 343/873; 343/872

(58) Field of Classification Search
None
See application file for complete search history.

(56) References Cited

U.S. PATENT DOCUMENTS

| | | | | |
|---|---|---|---|---|
| 7,271,769 | B2 * | 9/2007 | Asano et al. | 343/702 |
| 8,054,229 | B2 * | 11/2011 | Kaneoya | 343/702 |
| 8,080,995 | B2 * | 12/2011 | Yan et al. | 324/300 |
| 2006/0061512 | A1 * | 3/2006 | Asano et al. | 343/702 |
| 2006/0197712 | A1 * | 9/2006 | Niemi et al. | 343/873 |
| 2010/0035564 | A1 * | 2/2010 | Lee | 455/90.3 |
| 2010/0271272 | A1 * | 10/2010 | Sung et al. | 343/702 |
| 2011/0205141 | A1 * | 8/2011 | Hong et al. | 343/873 |
| 2011/0316753 | A1 * | 12/2011 | Wu et al. | 343/702 |
| 2012/0001806 | A1 * | 1/2012 | Hsiung | 343/702 |
| 2012/0235879 | A1 * | 9/2012 | Eder et al. | 343/873 |

FOREIGN PATENT DOCUMENTS

CN 101872890 A 10/2010

* cited by examiner

*Primary Examiner* — Trinh Dinh
(74) *Attorney, Agent, or Firm* — Novak Druce Connolly Bove + Quigg LLP

(57) ABSTRACT

A housing combination includes a housing, and at least two antenna modules embedded at corners of the housing. Each antenna module includes an antenna carrier and an antenna radiator. The antenna carrier defines a first receiving groove and a second receiving groove opposite to each other. The antenna radiator includes a main portion and a conductive contact. The main portion is received in the first receiving groove, and the conductive contact is received in the second receiving groove. The main portion is embedded in the housing, and the conductive contact is exposed from the housing.

2 Claims, 6 Drawing Sheets

HOUSING COMBINATION OF ELECTRONIC DEVICE AND METHOD

BACKGROUND

1. Technical Field

The present disclosure relates to housings of electronic devices, especially to a housing combination having antenna modules formed thereon and a method for making the housing combination.

2. Description of Related Art

Electronic devices, such as mobile phones, personal digital assistants (PDAs), and laptop computers are widely used. Most of these electronic devices have antenna modules for receiving and sending wireless signals. A typical antenna includes a thin metal radiating element mounted on a support member, and attached to a housing. However, the radiating element is usually exposed from the housing, and may be easily damaged and having a limited receiving effect. In addition, the radiating element and the support member occupy precious space.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the exemplary housing combination having antenna modules formed thereon. Moreover, in the drawings like reference numerals designate corresponding parts throughout the several views. Wherever possible, the same reference numbers are used throughout the drawings to refer to the same or like elements of an embodiment.

DETAILED DESCRIPTION

The disclosure is illustrated by way of example and not by way of limitation in the accompanying drawings. It should be noted that references to "an" or "one" embodiment in this disclosure are not necessarily to the same embodiment, and such references can include the meaning of "at least one" embodiment where the context permits.

Figure 1:
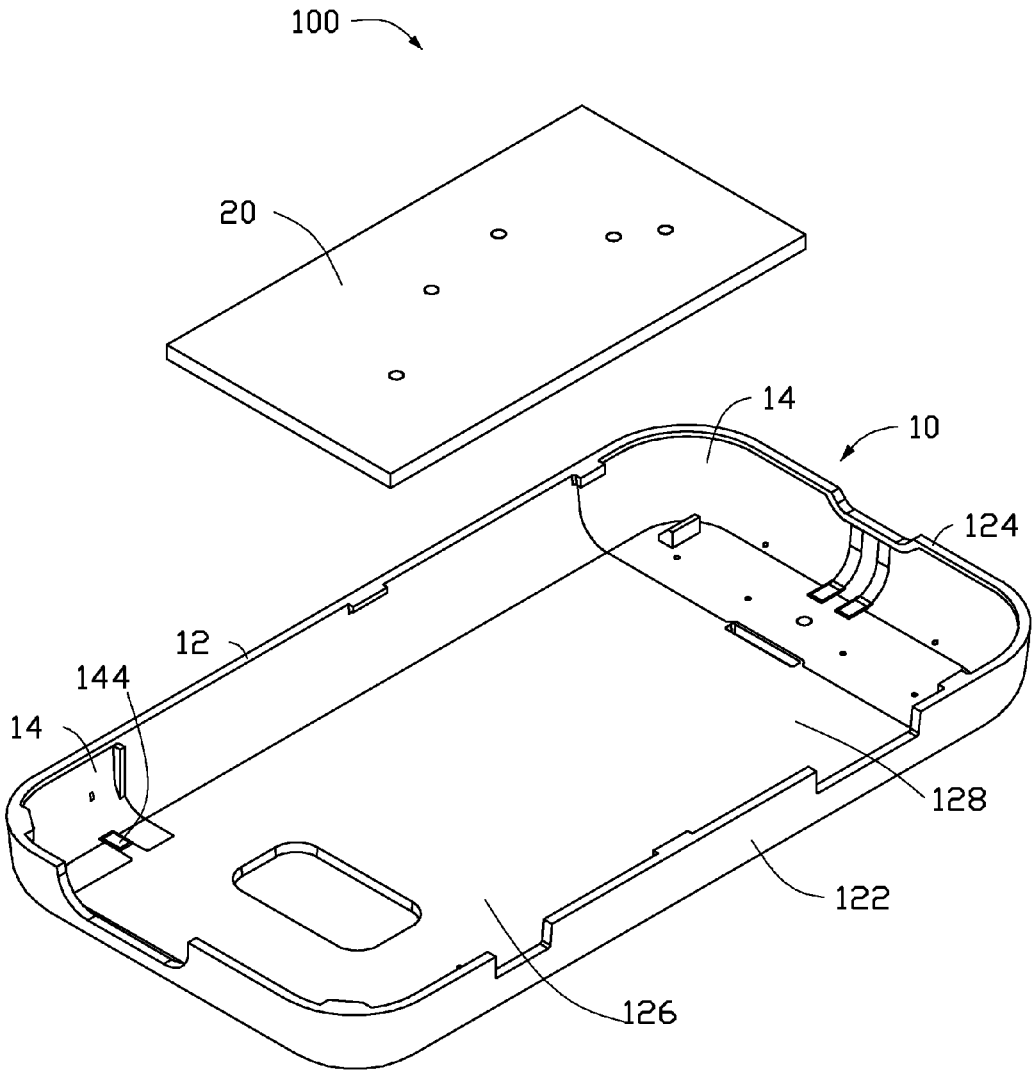
FIG. 1 is a schematic view of an exemplary embodiment of a housing combination applied in an electronic device.

FIG. 1 shows an exemplary embodiment of a housing combination 10 for an electronic device 100 where an antenna is desired, such as a mobile phone, or a PDA. The electronic device 100 includes a printed circuit board 20.

Figure 2:
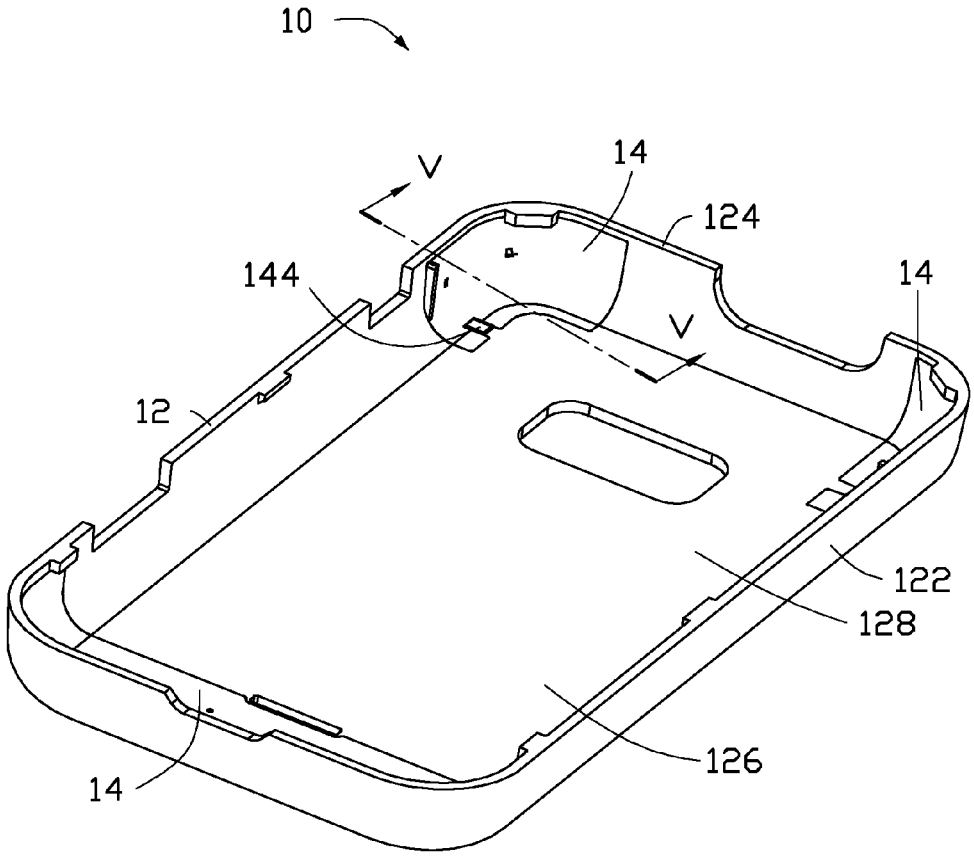
FIG. 2 is a schematic view of an exemplary embodiment of the housing combination including antenna modules shown in FIG. 1.

Referring to FIG. 2, the housing combination 10 includes a housing 12 and at least two antenna modules 14 embedded in the housing 12. In this exemplary embodiment, there are three antenna modules 14 on the housing 12. The housing 12 includes two opposite sidewalls 122, two opposite end walls 124 and a substantially rectangular base 126, thereby cooperatively surrounding a receiving cavity 128 for receiving the printed circuit board 20. The three antenna modules 14 are formed in the housing 12 by insert molding, and are positioned at three of four corners of the housing 12. This arrangement of the three antenna modules 14 may effectively avoid the three antennas from interfering with each other so that the electronic device can more accurately receive signals from the antenna modules 14 or transmit signals by the antenna modules 14.

Additionally, since the antenna modules 14 are electronically connected to the printed circuit board 20, the edge space of the printed circuit board 20 may be effectively used.

Figure 3:
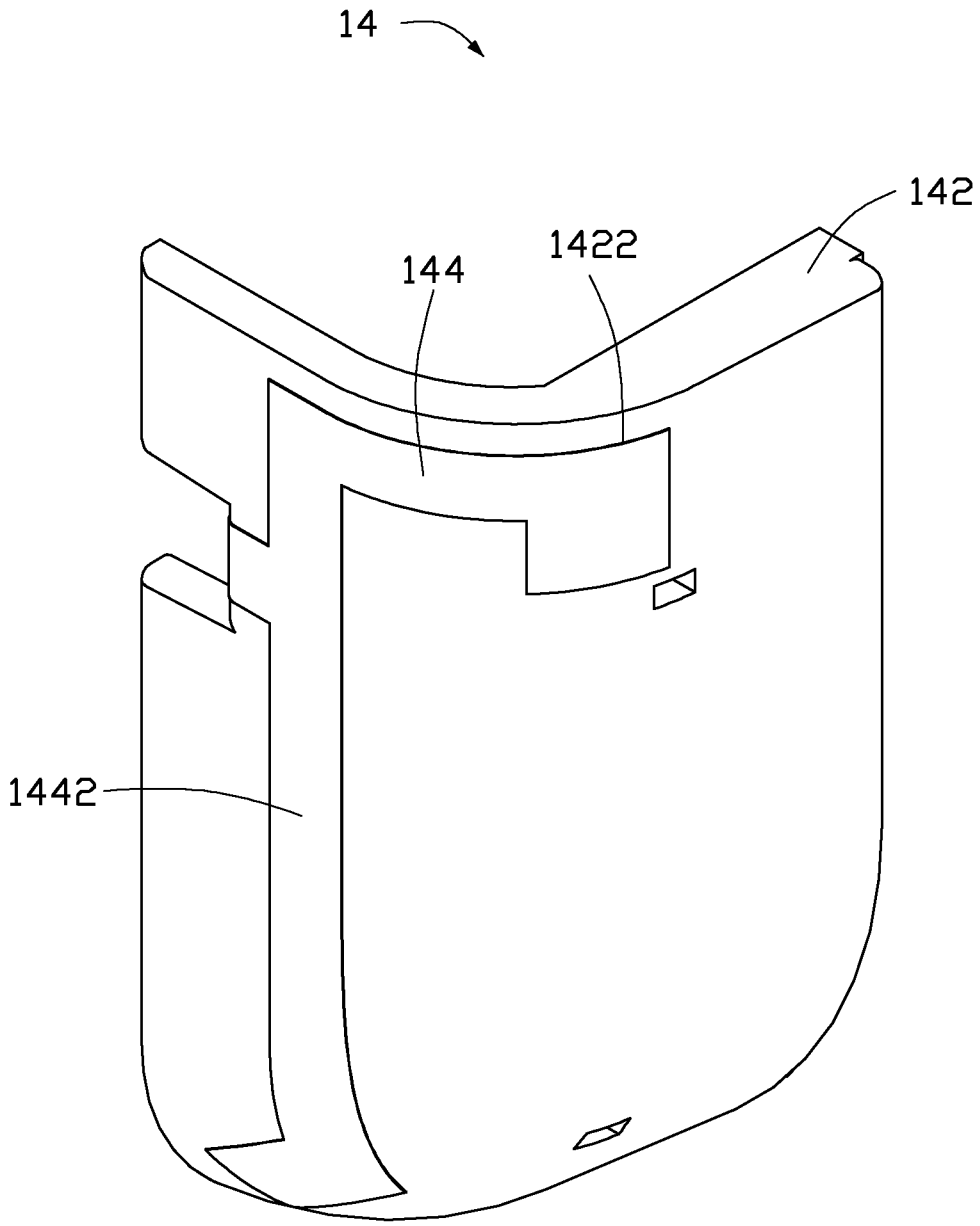
FIG. 3 is a schematic view of one of the antenna modules shown in FIG. 2.
Figure 4:
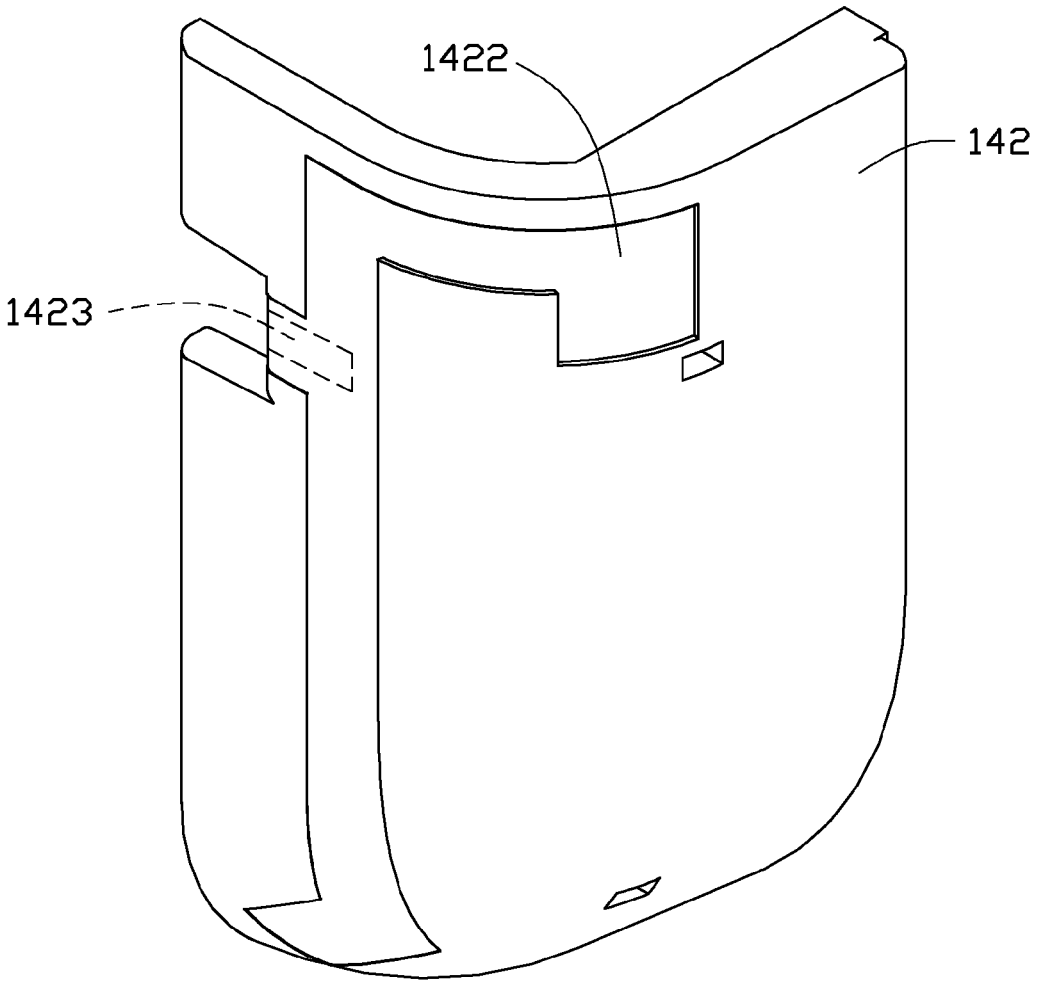
FIG. 4 is a schematic view of a carrier of FIG. 3.
Figure 5:
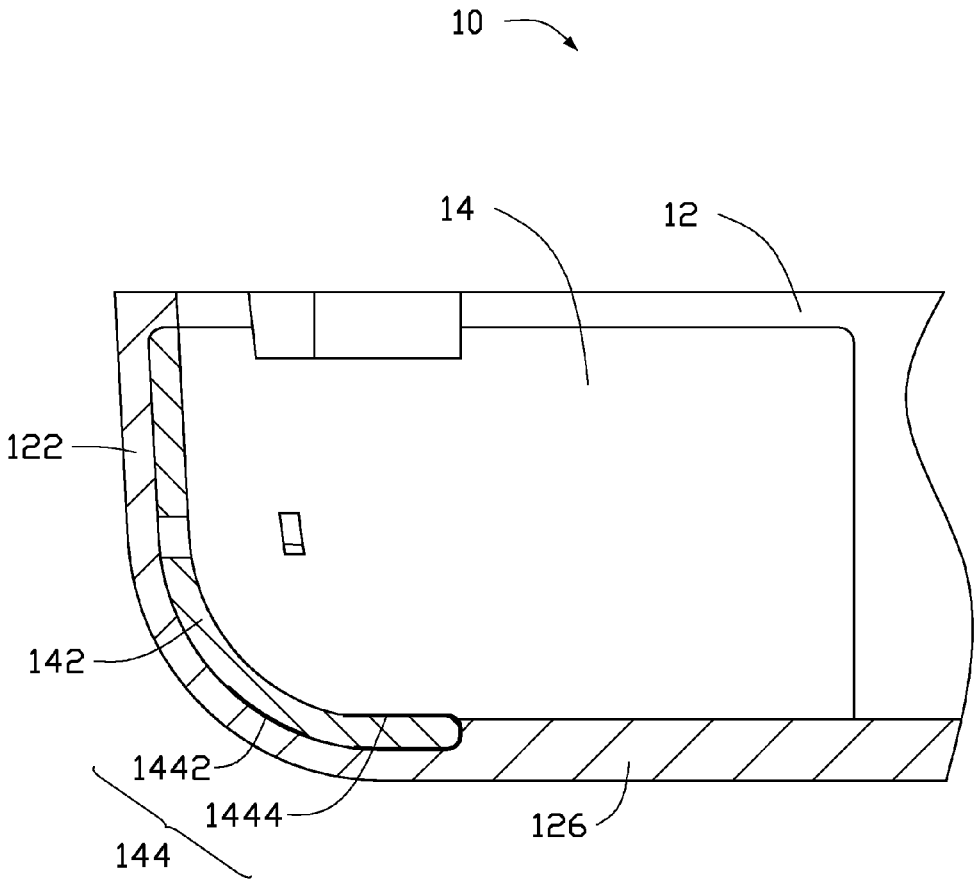
FIG. 5 is a cross-sectional view of the housing combination along line V-V of FIG. 2.

Referring to FIGS. 3 to 5, each antenna module 14 includes an antenna carrier 142 and an antenna radiator 144. The antenna carrier 142 defines a first receiving groove 1422 and a second receiving groove 1423. The first receiving groove 1422 is defined in one surface of the antenna carrier 142, and the second receiving groove 1423 is defined in an opposite surface of the antenna carrier 142. The antenna radiator 144 includes a main portion 1442 and a conductive contact 1444. The main portion 1442 is received in the first receiving groove 1422. The conductive contact 1444 is received in the second receiving groove 1423. The conductive contact 1444 is electrically connected to the printed circuit board 20.

A method for making the housing combination 10 of the embodiment includes the following steps:

Firstly, three antenna carriers 142 are provided. Each antenna carrier 142 is engraved by a laser to define the first, second receiving grooves 1422, 1423. The antenna radiator 144 is formed in the first, second receiving grooves 1422, 1423 using a plating process to form the antenna module 14.

Figure 6:
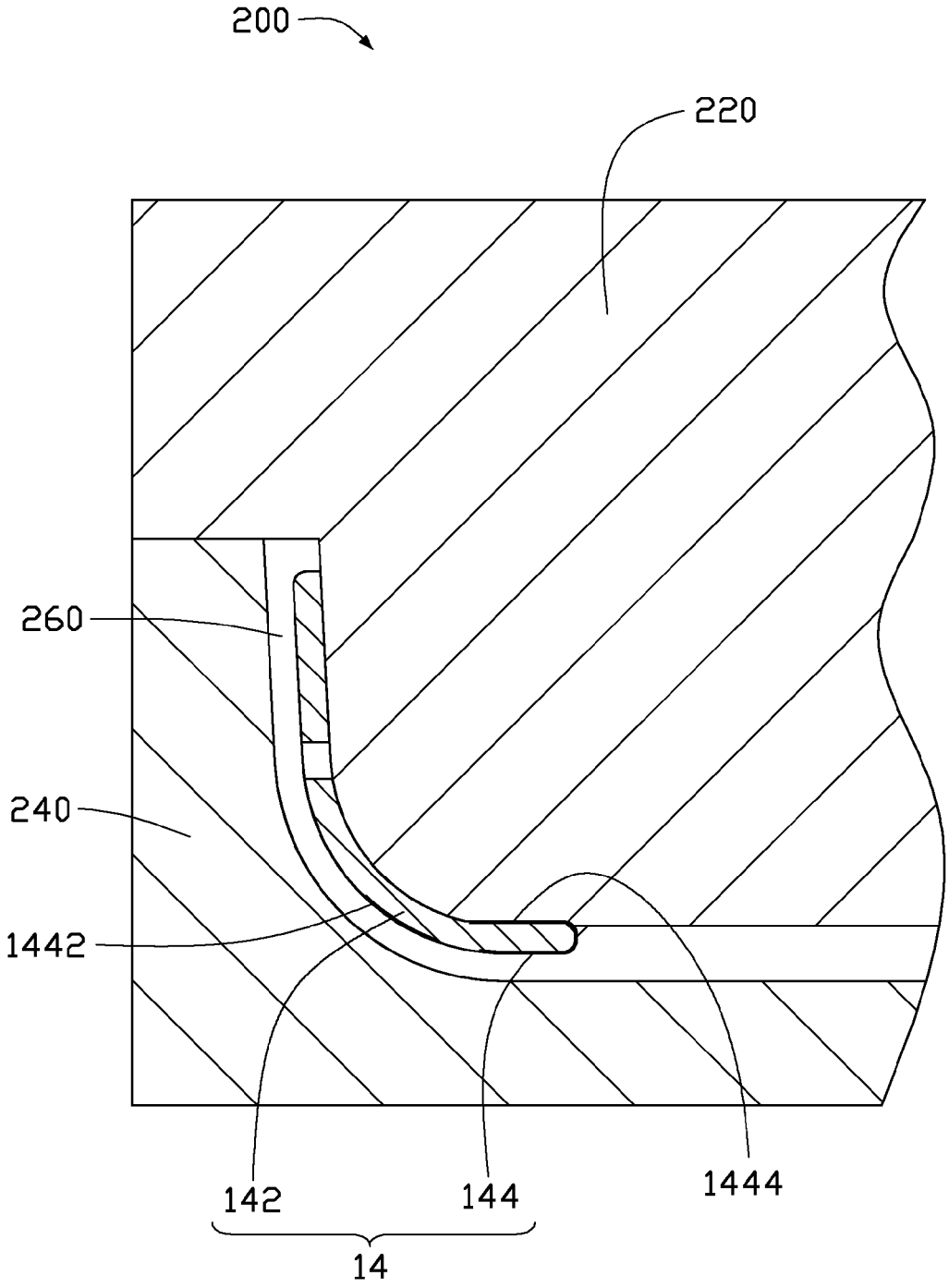
FIG. 6 is a schematic view of a mold apparatus for making the housing combination of FIG. 2.

Secondly, referring to FIG. 6, an injection molding machine 200 is provided. The injection molding machine 200 includes a male mold 220, and a female mold 240. A mold chamber 260 is defined between the male mold 220 and the female mold 240. The three antenna modules 14 are positioned in the mold chamber 260. The main portions 1442 face the mold chamber 260, and the conductive contacts 1444 abut against the male mold 220. Then, molten plastic material is injected into the mold chamber 260. The molten plastic material bonds to the carrier 142 and the antenna radiator 144 to form the housing combination 10. The main portions 1442 are embedded in the plastic material, and the conductive contact 1444 are exposed from the housing 12 and the carrier 14.

The antenna modules 14 are embedded in the housing 10 by insert-molding. The antenna modules 14 can be directly attached to the housing 12, thus, the working efficiency is increased. In addition, the main portions 1442 of the antenna radiator 144 are sandwiched between the carrier 142 and the housing 12 so that the antenna radiator 144 is protected from being damaged.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A housing combination comprising:

a housing;

at least two antenna modules embedded in the housing; each antenna module comprising:

an antenna carrier defining a first receiving groove and a second receiving groove opposite to each other;

an antenna radiator including a main portion and a conductive contact, the main portion received in the first receiving groove, and the conductive contact received in the second receiving groove;

wherein the main portion is embedded in the housing, and the conductive contact is exposed from the housing.

2. The housing as claimed of claim 1, wherein there are three antenna modules formed in the housing, and are positioned at three of four corners of the housing.

* * * * *